US006655685B2

(12) United States Patent
Tsai

(10) Patent No.: US 6,655,685 B2
(45) Date of Patent: Dec. 2, 2003

(54) THREE-DIMENSIONAL JIGSAW PUZZLE

(76) Inventor: Ching-Hung Tsai, No. 7, Lane 636, Wen-Chang Rd., Wu-Chi Chen, Taichung Hsien (TW)

( * ) Notice: Subject to any disclaimer, the term of this patent is extended or adjusted under 35 U.S.C. 154(b) by 0 days.

(21) Appl. No.: 10/093,179

(22) Filed: Mar. 7, 2002

(65) Prior Publication Data

US 2003/0168804 A1 Sep. 11, 2003

(51) Int. Cl.[7] ..... A63F 9/12
(52) U.S. Cl. ..... 273/157 R; 273/156
(58) Field of Search ..... 273/156, 157 R, 273/160; 446/117, 121, 122, 124

(56) References Cited

U.S. PATENT DOCUMENTS 2,610,856 A * 9/1952 Welty ..... 446/124
3,630,527 A * 12/1971 Breslow ..... 273/157 R
3,779,558 A * 12/1973 Moreau ..... 273/157 R
3,829,100 A * 8/1974 Nielsen ..... 273/157 R
4,040,630 A * 8/1977 Brattain ..... 273/157 R
4,678,192 A * 7/1987 Campbell ..... 273/157 R
5,178,391 A * 1/1993 Schoen ..... 273/157 R
5,782,667 A * 7/1998 Luby ..... 446/117
6,029,974 A * 2/2000 Povitz ..... 273/157 R

* cited by examiner

*Primary Examiner*—Steven Wong
(74) *Attorney, Agent, or Firm*—Marshall & Melhorn, LLC

(57) ABSTRACT

A three-dimensional jigsaw puzzle includes a three-dimensional core body having a vertical axis and including a plurality of stackable block units formed by cutting the core body along a plurality of transverse cutting planes that are transverse to the vertical axis. Each of the block units has top and bottom surfaces which are opposite to each other in a vertical direction that is parallel to the vertical axis, and includes at least two block members formed by cutting each of the stackable block units along at least one vertical cutting plane that is parallel to and that passes through the vertical axis. A plurality of interlocking members are disposed to interlock removably an adjacent pair of the block units.

13 Claims, 13 Drawing Sheets

THREE-DIMENSIONAL JIGSAW PUZZLE

BACKGROUND OF THE INVENTION

1. Field of the Invention

The invention relates to, a jigsaw puzzle, more particularly to a three-dimensional jigsaw puzzle.

2. Description of the Related Art

Conventional jigsaw puzzles are generally two-dimensional and are not attractive to consumers. Although there are available two-dimensional jigsaw puzzles with a three-dimensional visual effect, they are still not very interesting.

There are also available building blocks that can be interlocked to form a desirable shape or figure, such as the building blocks available under the trademark Lego®. As such building blocks are generally rectangular or square blocks, when they are used to form an object, such as a vase, the object will have an irregular surface with many angles, and is thus not visually appealing.

SUMMARY OF THE INVENTION

Therefore, the main object of the present invention is to provide a three-dimensional jigsaw puzzle that is attractive to consumers and that has an enhanced three-dimensional effect.

Accordingly, a three-dimensional jigsaw puzzle of this invention includes:

a three-dimensional core body having a vertical axis, the core body including a plurality of stackable block units formed by cutting the core body along a plurality of transverse cutting planes that are transverse to the vertical axis, each of the stackable block units having top and bottom surfaces which are opposite to each other in a vertical direction that is parallel to the vertical axis, each of the stackable block units including at least two block members formed by cutting each of the stackable block units along at least one vertical cutting plane that is parallel to and that passes through the vertical axis; and a plurality of interlocking members that are disposed to interlock removably an adjacent pair of the stackable block units.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
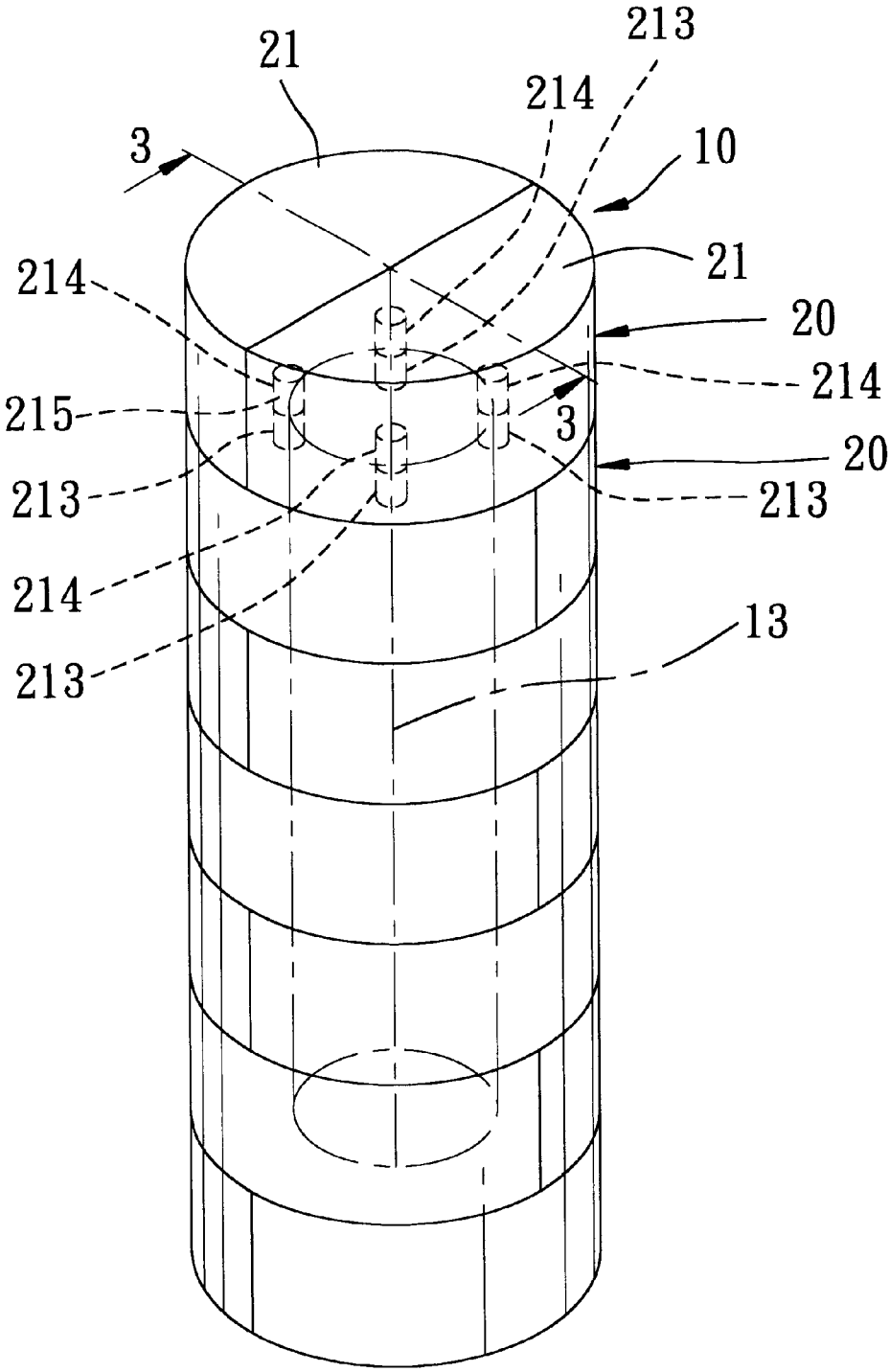
FIG. 1 is an assembled perspective view of the first preferred embodiment of a three-dimensional jigsaw puzzle according to the invention.

Before the invention is described in greater detail, it should be noted that like.elements are denoted by the same reference numerals throughout the disclosure.

Figure 2:
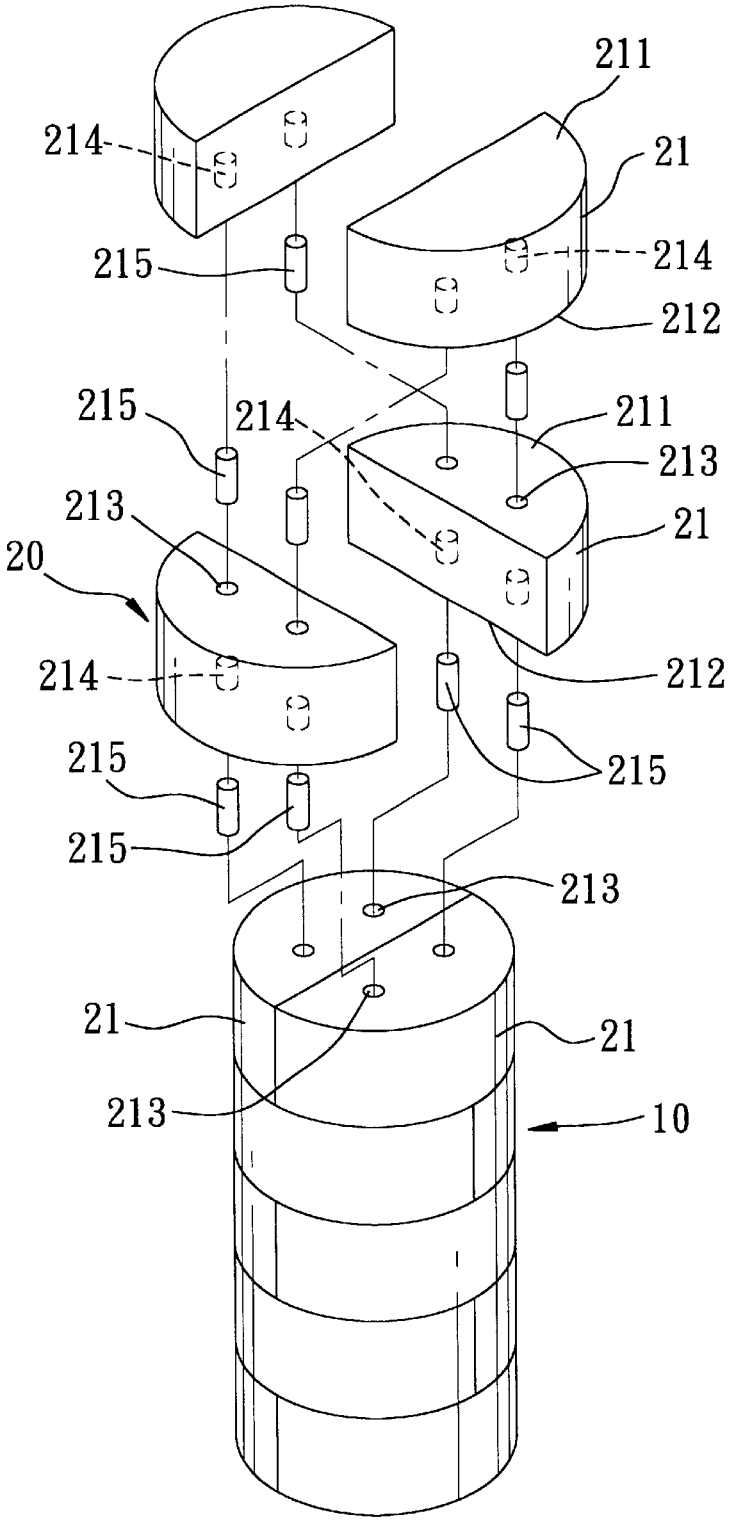
FIG. 2 is a partly exploded perspective view of the first preferred embodiment.
Figure 3:
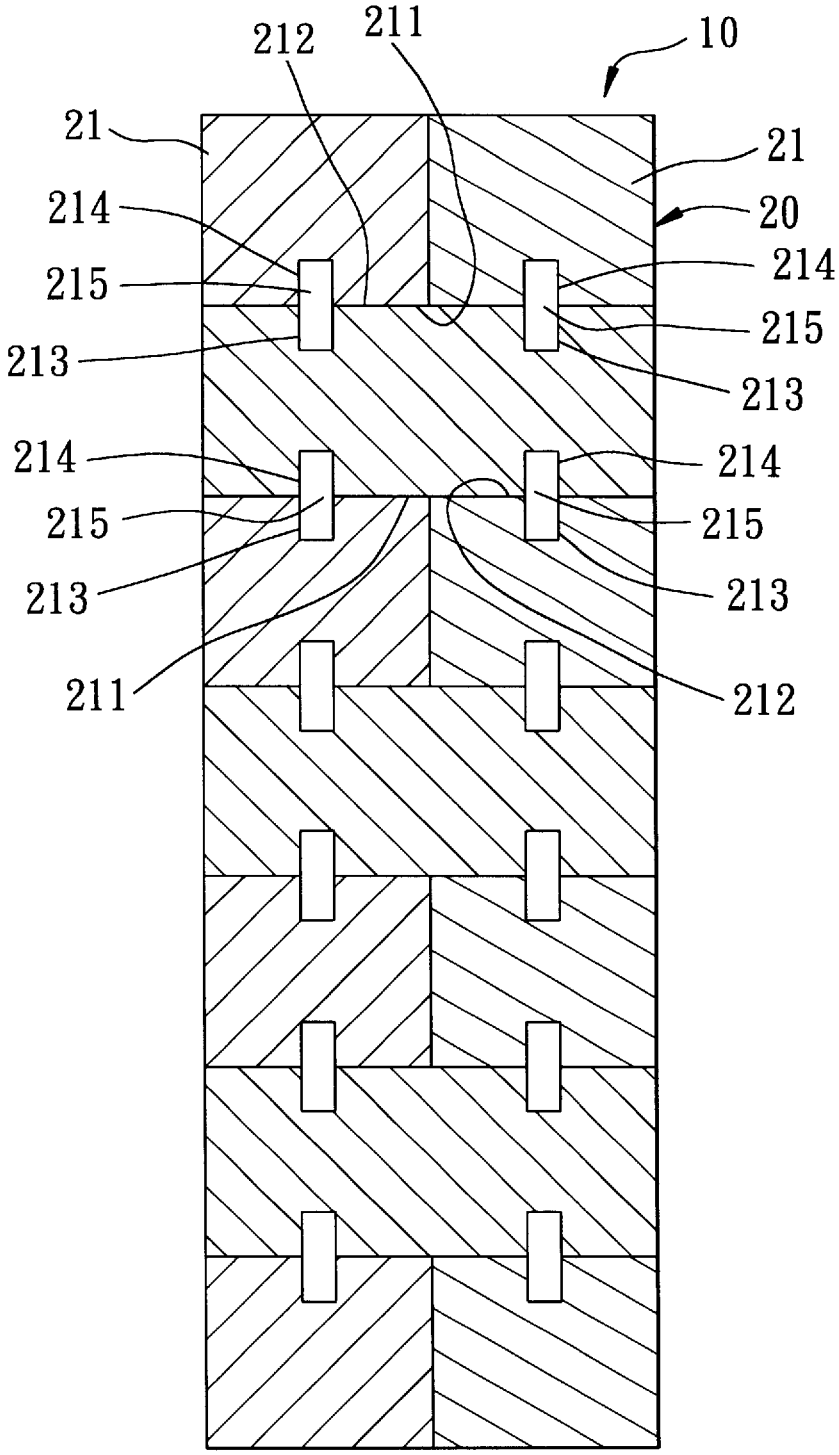
FIG. 3 is a sectional view of the first preferred embodiment taken along line 3—3 of FIG. 1.

Referring to FIGS. 1 to 3, the first preferred embodiment of a three-dimensional jigsaw puzzle according to the invention is shown to include a three-dimensional core body 10 and a plurality of interlocking members. The core body 10 has a vertical axis 13, and a uniform cross-section along the vertical axis 13. The core body 10 includes a plurality of stackable block units 20 formed by cutting the core body 10 along a plurality of transverse cutting planes that are transverse to the vertical axis 13. Each of the stackable block units 20 has top and bottom surfaces 211, 212 which are opposite to each other in a vertical direction that is parallel to the vertical axis 13, and includes two equal block members 21 formed by cutting each of the stackable block units 20 along a vertical cutting plane that is parallel to and that passes through the vertical axis 13. The vertical cutting plane that cuts an upper one of the stackable block units 20 is staggered relative to and forms an angle with the vertical cutting plane that cuts a lower one of the stackable block units 20 which is adjacent to the upper one of the stackable block units 20.

The interlocking members are disposed to interlock removably an adjacent pair of the stackable block units 20, and are arranged around the vertical axis 13. In this embodiment, the interlocking members include four first holes 213 formed in the top surfaces 211 of the block members 21 of the stackable block units 20, and four second holes 214 formed in the bottom surfaces 212 of the block members 21 of the stackable block units 2. It is noted that the first holes 213 are not formed in the topmost one of the stackable block units 20, and that the second holes 214 are likewise not formed in the bottommost one of the stackable block units 20. The interlocking members further include a plurality of pins 215 that removably engage the first holes 213 formed in the top surface 211 of a lower one of the stackable block unit 20 and the second holes 214 formed in the bottom surface 212 of an upper one of the stackable block unit 20 which is adjacent to the lower one of the stackable block units 20. In this embodiment, the interlocking members on the same one of the top and bottom surfaces 211, 212 of each of the stackable block units 20 are equidistant from the vertical axis 13, i.e., the interlocking members on the top or bottom surface 211, 212 of each of the stackable block units 20 lie on the circumference of an imaginary circle centered on the vertical axis 13.

In play, the pins 215 are used to connect the block members 21 of an upper one of the stackable block units 20 to the block members 21 of a lower one of the stackable block units 20 such that the vertical cutting plane of the upper one of the stackable block units 20 is at a right angle relative to that of the lower one of the stackable block units 20. In other words, each of the block members 21 of the upper one of the stackable block units 20 straddles over the block members 21 of the lower one of the stackable block units 20 at the same time. The stackable block units 20 are interlocked in this manner to form the core body 10.

Figure 4:
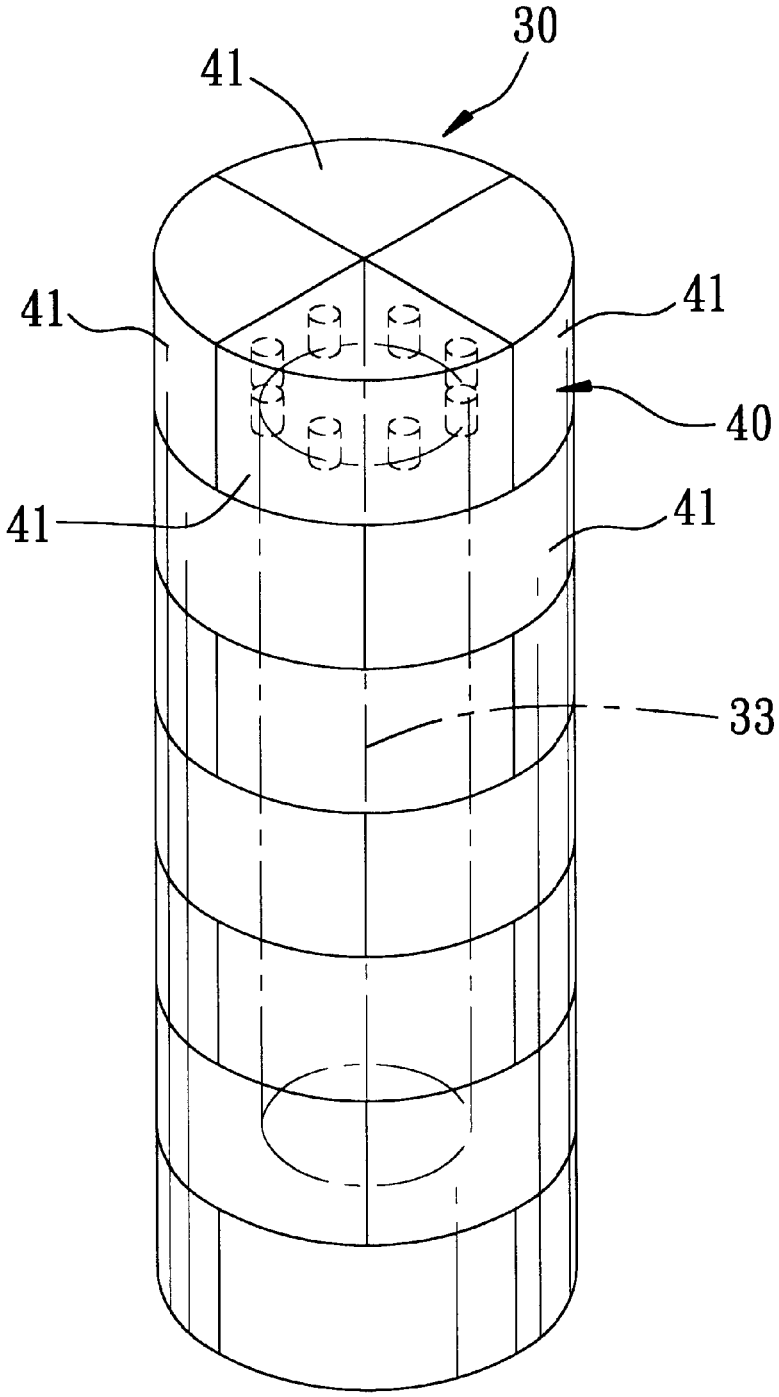
FIG. 4 is an assembled perspective view of the second preferred embodiment of a three-dimensional jigsaw puzzle according to the invention.
Figure 5:
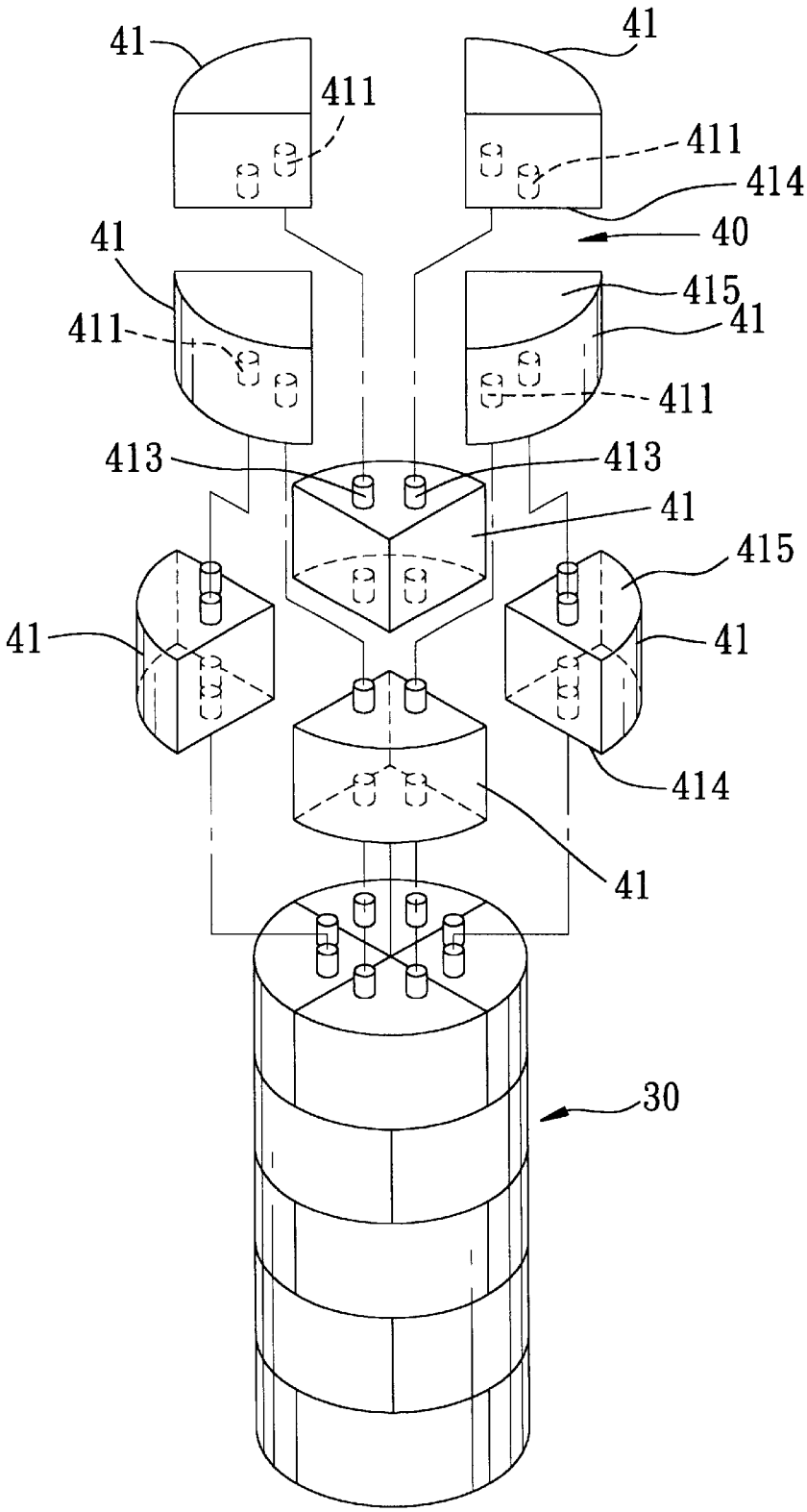
FIG. 5 is a partly exploded perspective view of the second preferred embodiment.

Referring to FIGS. 4 and 5, the second preferred embodiment of a three-dimensional jigsaw puzzle according to the invention is shown to include a three-dimensional core body 30 having a vertical axis 33. The core body 30 includes a plurality of stackable block units 40 that are interlocked via a plurality of interlocking members. This embodiment is substantially similar to the previous embodiment. The major difference therebetween resides in that each of the stackable block units 40 includes four equal block members 41 formed by cutting each of the stackable block units 40 along two vertical cutting planes that are at right angles relative to each other. The vertical cutting planes of an upper one of the stackable block units 40 are staggered relative to those of a lower one of the stackable block units 40. The interlocking members include a plurality of first holes 411 formed in bottom surfaces 414 of the stackable block units 40, and a plurality of pins 413 formed integrally on top surfaces 415 of the stackable block units 40 to engage the first holes 411, respectively. It is noted that the pins 413 are not formed on the top surface 415 of the topmost one of the stackable block units 40.

In play, the block members 41 of the stackable block units 40 are interconnected to form the core body 40 in a manner substantially the same as that described in the previous embodiment. That is, each of the block members 41 of an upper one of the stackable block units 40 straddles over two of the block members 41 of a lower one of the stackable block units 40 at the same time so that the vertical cutting planes of an adjacent pair of the stackable block units 40 are staggered.

Figure 6:
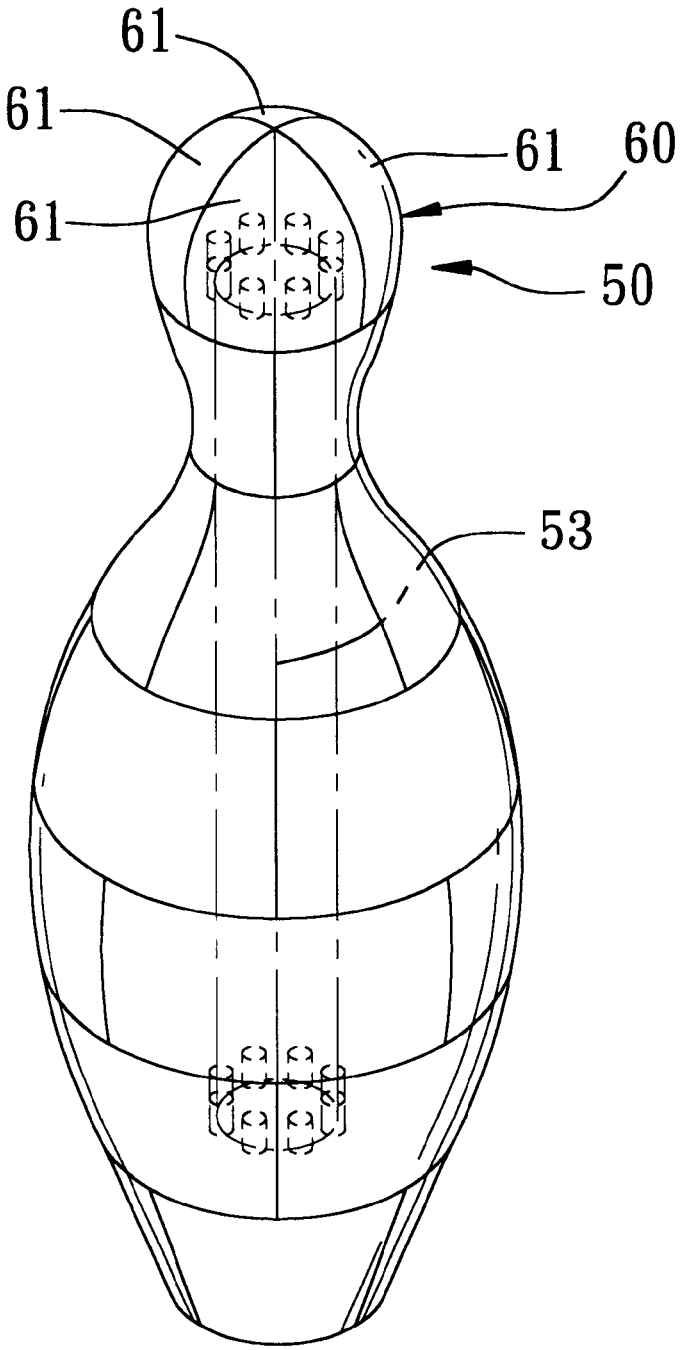
FIG. 6 is an assembled perspective view of the third preferred embodiment of a three-dimensional jigsaw puzzle according to the invention.
Figure 7:
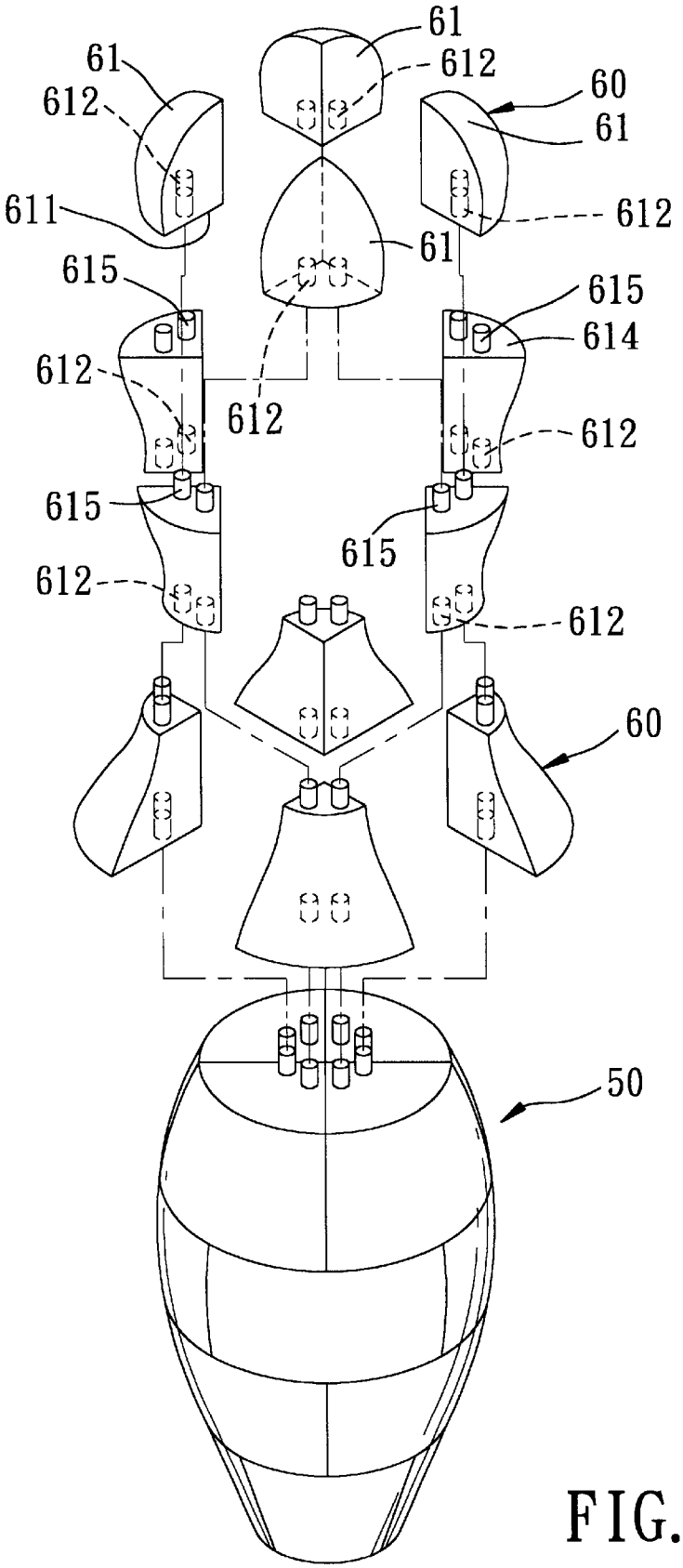
FIG. 7 is a partly exploded perspective view of the third preferred embodiment.

Referring to FIGS. 6 and 7, the third preferred embodiment of a three-dimensional jigsaw puzzle according to the invention is shown to comprise a core body 50 and a plurality of interlocking members. The core body 50 has a vertical axis 53 and includes a plurality of stackable block units 60. Each of the stackable block units 60 includes four equal block members 61 formed by cutting each of the stackable block units 60 along two vertical cutting planes that are at right angles relative to each other. The vertical cutting planes of an upper one of the stackable block units 60 are staggered relative to the vertical cutting planes of a lower one of the stackable block units 60. The interlocking members include a plurality of first holes 612 formed in bottom surfaces 611 of the stackable block units 60, and a plurality of pins 615 formed integrally on top surfaces 614 of the stackable block units 60 to engage the first holes 612. It is noted that the pins 615 are not provided on the top surface 614 of the topmost one of the stackable block units 60.

This embodiment is substantially similar to the previous embodiments, but is different therefrom mainly in that the core body 50 has a shape resembling a bowling pin, which has a non-uniform cross-section along the vertical axis 53.

Figure 8:
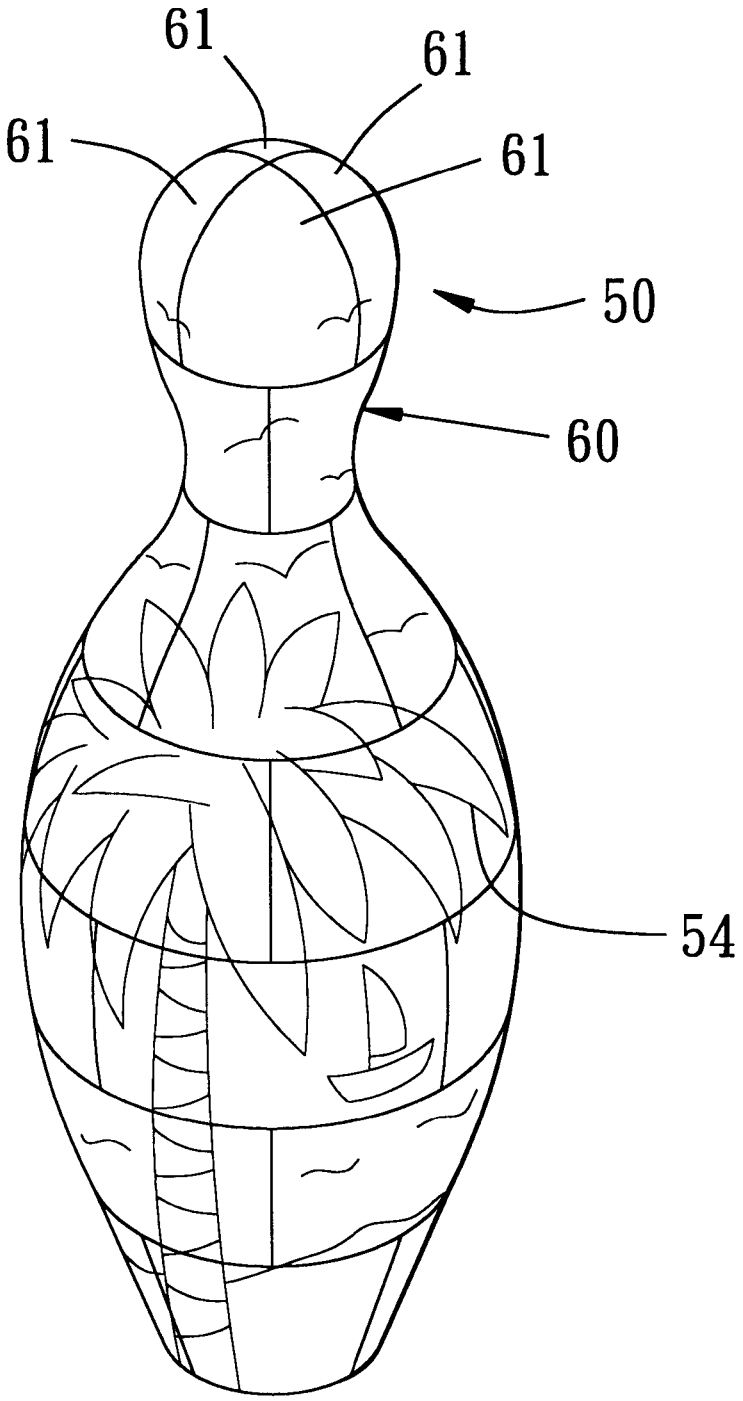
FIG. 8 is a perspective view of the third preferred embodiment in a modified form.

Furthermore, this embodiment can be modified to have a patterned outer surface 54, such as that shown in FIG. 8.

Figure 9:
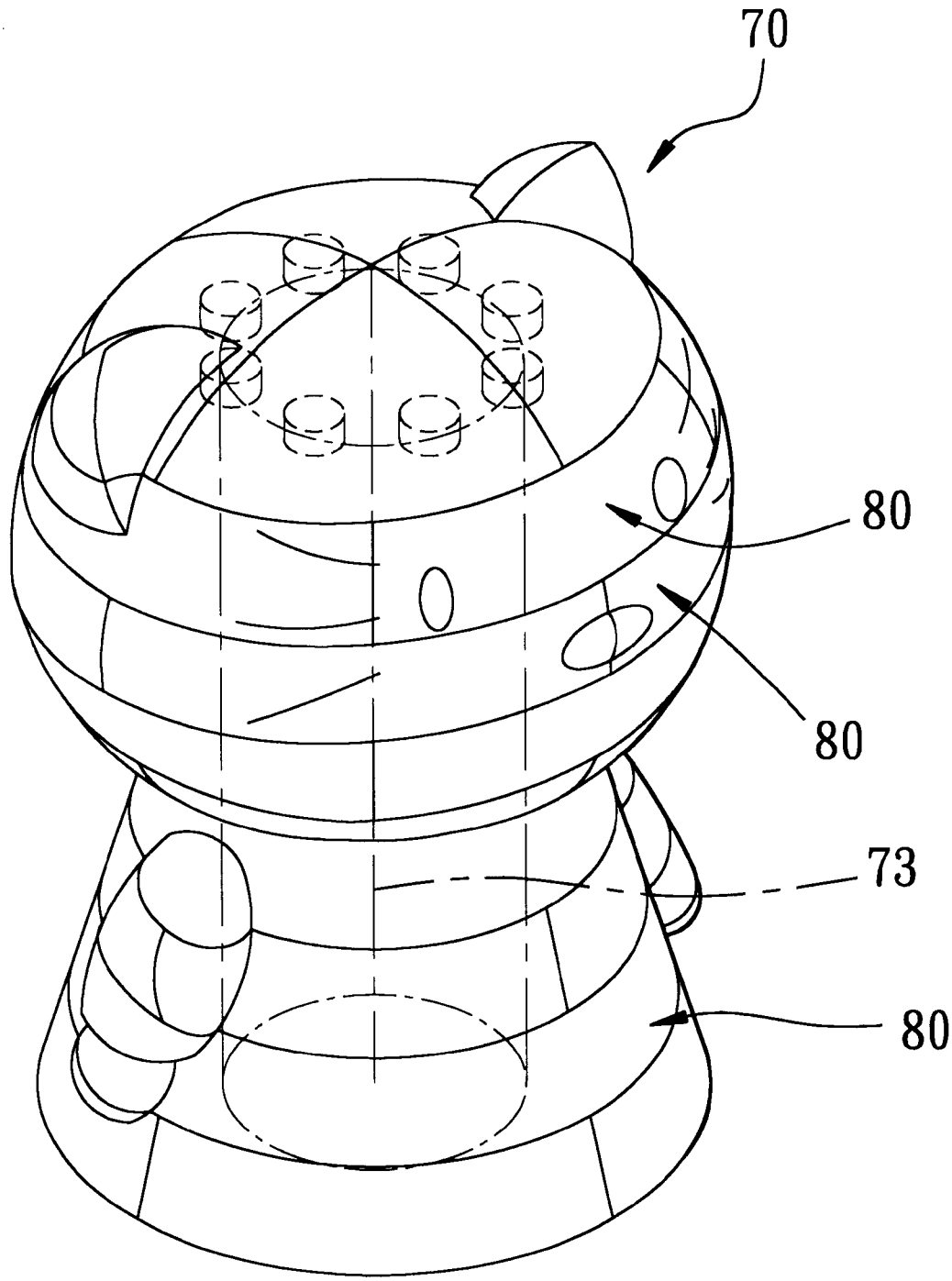
FIG. 9 is an assembled perspective view of the fourth preferred embodiment of the three-dimensional jigsaw puzzle according to the invention.

Referring to FIG. 9, the fourth preferred embodiment of a three-dimensional jigsaw puzzle according to the invention is shown to comprise a core body 70 which has a vertical axis 73 and which includes a plurality of stackable block units 80. The major difference between this embodiment and the previous embodiments resides in that the core body 70 has an appearance in the form of a cartoon character.

Figure 10:
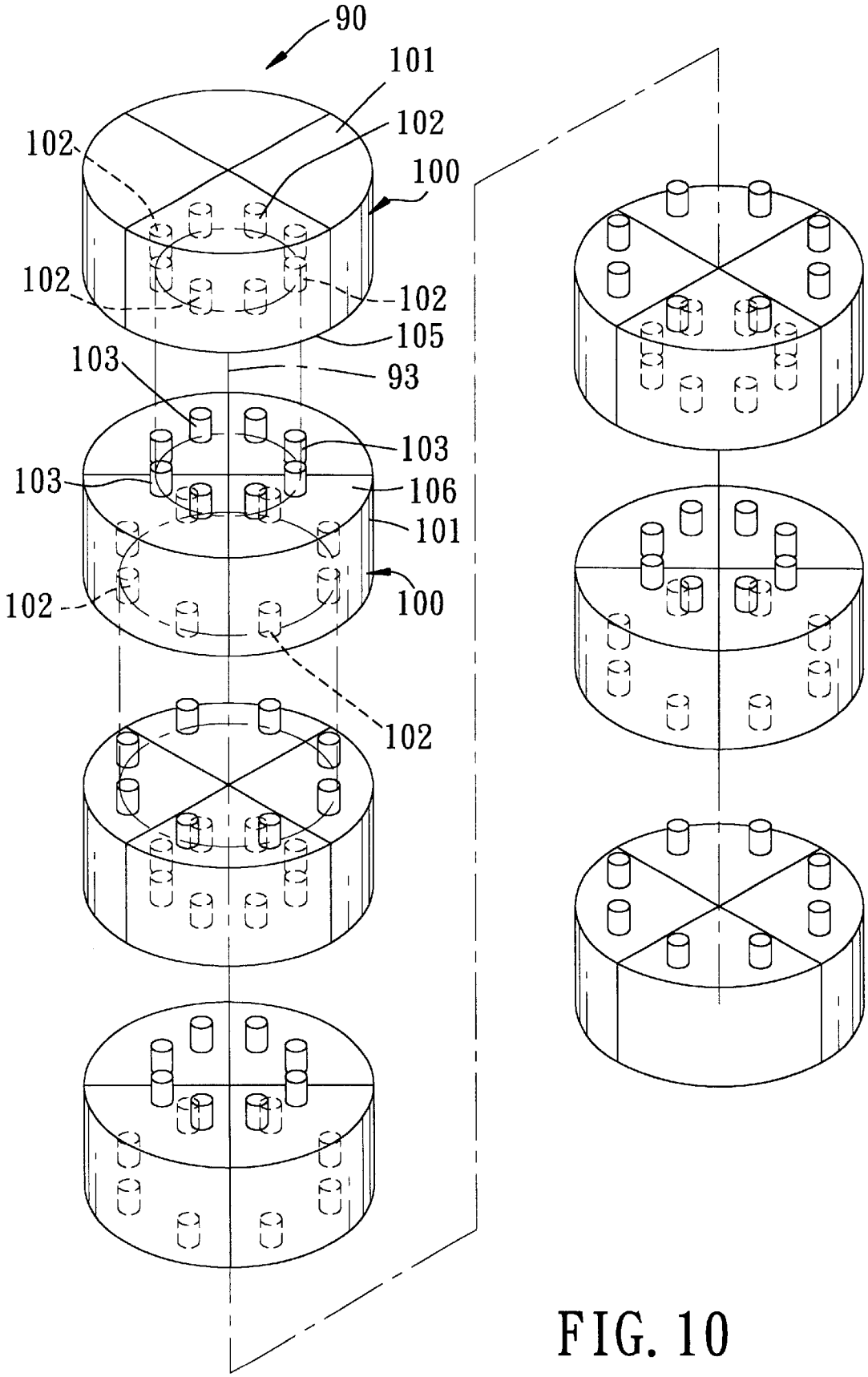
FIG. 10 is a partly exploded perspective view of the fifth preferred embodiment of the three-dimensional jigsaw puzzle according to the invention.
Figure 11:
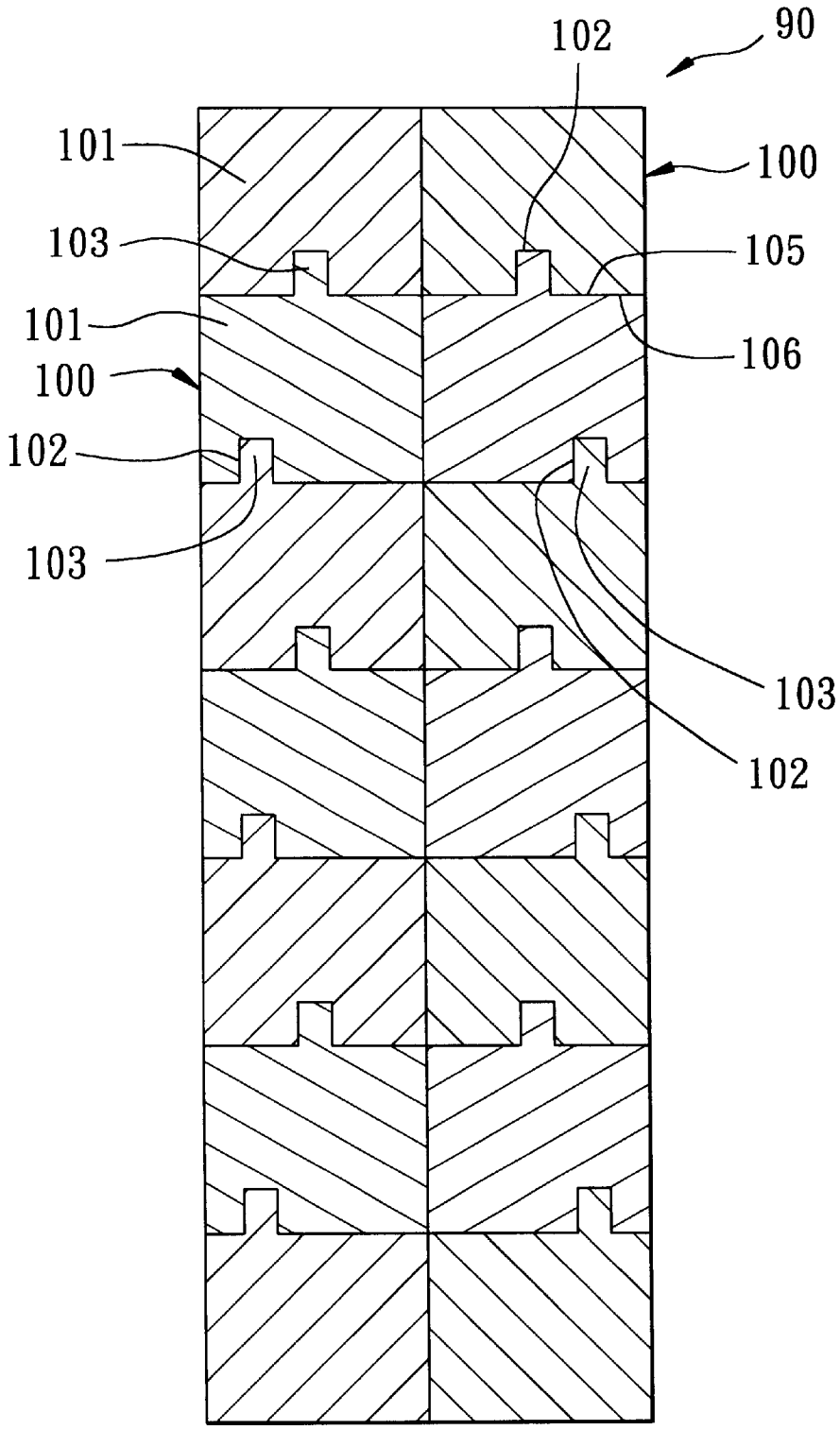
FIG. 11 is a sectional view of the fifth preferred embodiment in an assembled state.

Referring to FIGS. 10 and 11, the fifth preferred embodiment of a three-dimensional jigsaw puzzle according to the invention is shown to include a core body 90 and a plurality of interlocking members. The core body 90 has a vertical axis 93 and includes a plurality of stackable block units 100. Each of the stackable block units 100 includes four equal block members 101. The interlocking members include a plurality of first holes 102 formed in bottom surfaces 105 of each of the stackable block units 100, and a plurality of pins 103 formed integrally on top surfaces 106 of each of the stackable block units 100. This embodiment differs from the previous embodiments mainly in that the first holes 102 in the bottom surface 105 of one of the stackable block units 100 are spaced apart from the vertical axis 93 by a first radial distance. The pins 103 on the top surface 106 of the same one of the stackable block units 100 are spaced apart from the vertical axis 93 by a second radial distance different from the first radial distance. It is noted that, in this arrangement, the first holes 102 in the bottom surface 105 of an upper one of the stackable block units 100 and the pins 103 on the top surface 106 of a lower one of the stackable block units 100 are spaced apart equidistantly from the vertical axis 93 so as to permit interlocking of an adjacent pair of the stackable block units 100 in the manner as described hereinbefore.

Figure 12:
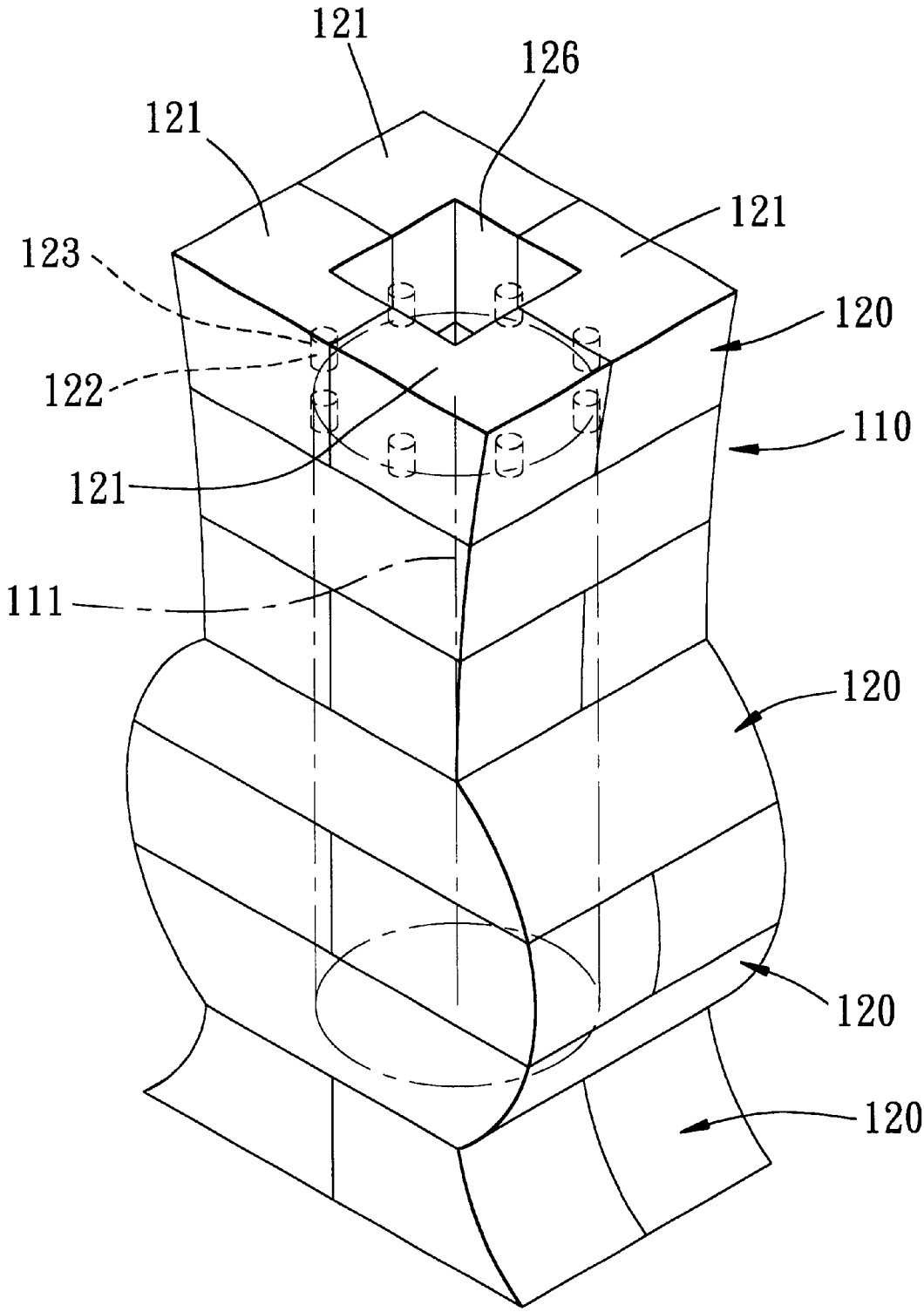
FIG. 12 is an assembled perspective view of the sixth preferred embodiment of the three-dimensional jigsaw puzzle according to the invention.
Figure 13:
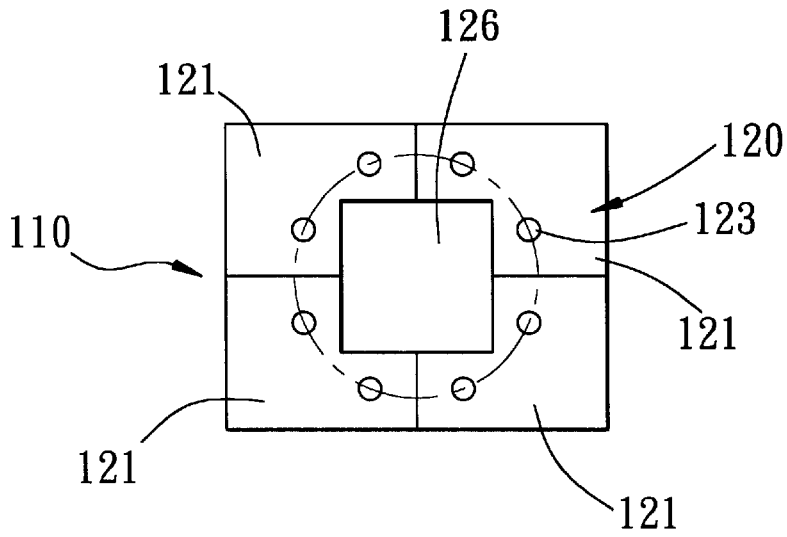
FIG. 13 is a schematic top view of a stackable block unit of the sixth preferred embodiment.

Referring to FIGS. 12 and 13, the sixth preferred embodiment of a three-dimensional jigsaw puzzle according to the invention is shown to comprise a core body 110 having a vertical axis 111 and including a plurality of stackable block units 120. Each of the stackable block units 120 includes a plurality of block members 121. The stackable block units 120 are interconnected via interlocking members which include holes 123 formed in bottom surfaces of the stackable block units 120 and pins 122 formed integrally on top surfaces of the stackable block units 120. This embodiment differs from the previous embodiments mainly in that the core body 110 has a non-uniform cross-section along the vertical axis 111, and has a top end, a bottom end opposite to the top end along the vertical axis 111, and a blind bore 126 that extends from the top end toward the bottom end along the vertical axis 111 and that has a square cross-section. The interlocking members are disposed around the blind bore 126. This embodiment can be adapted for use as a vase, a pen holder, or the like.

Figure 14:
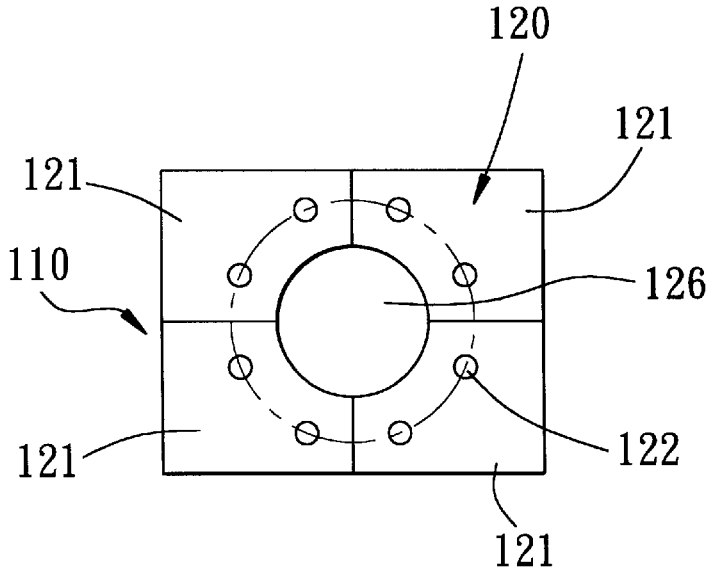
FIG. 14 is a schematic top view of a stackable block unit of the sixth preferred embodiment in a modified form.

Referring to FIG. 14, the blind bore 126 can also be configured to have a circular cross-section.

By virtue of the aforesaid construction, a three-dimensional jigsaw puzzle of this invention, when assembled to form a figure or sculpture, has a symmetrical appearance and smooth contour lines that enhance the three-dimensional or realistic aspect of the figure or sculpture.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A three-dimensional jigsaw puzzle, comprising:

a three-dimensional core body having a vertical axis, said core body including a plurality of stackable block units formed by cutting said core body along a plurality of transverse cutting planes that are transverse to said vertical axis, each of said stackable block units having top and bottom surfaces which are opposite to each other in a vertical direction that is parallel to the vertical axis, each of said stackable block units including at least two block members formed by cutting each of said stackable block units along at least one vertical cutting plane that is parallel to and that passes through said vertical axis; and a plurality of interlocking members that are disposed to interlock removably an adjacent pair of said stackable block units;

wherein said interlocking members are provided on said top and bottom surfaces of said stackable block units, said interlocking members on the same one of said top and bottom surfaces of each of said stackable block units are equidistant from said vertical axis; and further, wherein said interlocking members on said top surface of one of said stackable block units are spaced apart from said vertical axis by a first radial distance, said interlocking members on said bottom surface of said one of said stackable block units being spaced apart from said vertical axis by a second radial distance different from the first radial distance.

2. The three-dimensional jigsaw puzzle as claimed in claim 1, wherein said at least one vertical cutting plane that cuts an upper one of said stackable block units is staggered relative to said at least one vertical cutting plane that cuts a lower one of said stackable block units which is adjacent to said upper one of said stackable block units.

3. The three-dimensional jigsaw puzzle as claimed in claim 1, wherein said interlocking members are arranged around said vertical axis.

4. The three-dimensional jigsaw puzzle as claimed in claim 1, wherein said interlocking members include:

a plurality of first holes formed in one of said top surface of a lower one of said stackable block units and said bottom surface of an upper one of said stackable block units; and a plurality of pins provided on the other one of said top surface of said lower one of said stackable block units and said bottom surface of said upper one of said stackable block units, said pins removably engaging said first holes to interlock removably said adjacent pair of said stackable block units.

5. The three-dimensional jigsaw puzzle as claimed in claim 4, wherein the other one of said top surface of said lower one of said stackable block units and said bottom surface of said upper one of said stackable block units is formed with a plurality of second holes for removably engaging said pins.

6. The three-dimensional jigsaw puzzle as claimed in claim 4, wherein the other one of said top surface of said lower one of said stackable block units and said bottom surface of said upper one of said stackable block units is formed integrally with said pins.

7. The three-dimensional jigsaw puzzle as claimed in claim 1, wherein said core body has a uniform cross-section along said vertical axis.

8. The three-dimensional jigsaw puzzle as claimed in claim 1, wherein said core body has a non-uniform cross-section along said vertical axis.

9. The three-dimensional jigsaw puzzle as claimed in claim 1, wherein said core body has a patterned outer surface.

10. The three-dimensional jigsaw puzzle as claimed in claim 1, wherein said core body has a top end, a bottom end opposite to said top end along said vertical axis, and a blind bore that extends from said top end toward said bottom end along said vertical axis.

11. The three-dimensional jigsaw puzzle as claimed in claim 10, wherein said blind bore has a non-circular cross-section.

12. The three-dimensional jigsaw puzzle as claimed in claim 10, wherein said blind bore has a circular cross-section.

13. The three-dimensional jigsaw puzzle as claimed in claim 10, wherein said interlocking members are disposed around said blind bore.

* * * * *